United States Patent [19]

Goodrich et al.

[11] 4,066,320

[45] Jan. 3, 1978

[54] ELECTRICAL CONDUCTOR TERMINATING SYSTEM

[75] Inventors: Allen R. Goodrich, Groveland; Chauncey M. Horton, Jr., North Andover, both of Mass.; Leigh M. Thaeler, Derry, N.H.; John O. Toivola, Haverhill, Mass.

[73] Assignee: Western Electric Company, Inc., New York, N.Y.

[21] Appl. No.: 728,340

[22] Filed: Sept. 30, 1976

[51] Int. Cl.[2] ..... H01R 9/08

[52] U.S. Cl. ..... 339/98

[58] Field of Search ..... 339/97–99, 339/198 R

[56] References Cited

U.S. PATENT DOCUMENTS

| | | | |
|---|---|---|---|
| 2,567,783 | 9/1951 | Richardson | 339/99 R |
| 3,239,796 | 3/1966 | Buchanan et al. | 339/97 |
| 3,798,587 | 3/1974 | Ellis, Jr. et al. | 339/97 P |
| 3,945,705 | 3/1976 | Seim et al. | 339/98 |
| 3,957,335 | 5/1976 | Troy | 339/198 R |

FOREIGN PATENT DOCUMENTS

| | | | |
|---|---|---|---|
| 2,253,290 | 6/1975 | France | 339/98 |
| 661,480 | 11/1951 | United Kingdom | 339/99 R |

*Primary Examiner*—Roy Lake
*Assistant Examiner*—Neil Abrams
*Attorney, Agent, or Firm*—D. D. Bosben

[57] ABSTRACT

A terminal strip assembly of an electrical conductor terminating system includes an insulating terminal support block having a transverse bight or body portion and rows of electrical conductor guide portions projecting outward with respect to one side of the bight portion in spaced parallel opposed relationship. A row of U-shaped terminals is mounted on the support block and each terminal includes bifurcated legs which extend within respective adjacent ones of the guide portions to receive electrical conductors inserted between the guide portions. The terminals are retained on the support block by a releasably mounted retaining member. Wires may be connected to the legs of the terminals in the terminal strip assembly individually or in pairs utilizing bulk cable. In the alternative, wires may be connected to the legs of the terminals utilizing cables having wires which have been prefabricated into a spaced relationship corresponding to the spaced relationship of the legs in the terminal strip assembly, in various manners.

10 Claims, 16 Drawing Figures

ELECTRICAL CONDUCTOR TERMINATING SYSTEM

BACKGROUND OF THE INVENTION

1. Field of the Invention

This invention relates to an electrical conductor terminating system, and more particularly to an electrical conductor terminating system in which electrical apparatus can be installed in the field utilizing either bulk cable on a single or paired wire quick-connect basis, or prefabricated cable on a multiwire-connect basis, or various combinations of these two wiring methods.

2. Description of the Prior Art

It is standard practice in the installation of certain types of electrical apparatus in the field, such as telecommunications transmission equipment bays in a telephone central office, to interconnect the equipment bays to one another by suitable cabling. This interconnection has been accomplished in a variety of ways, including the use of (1) formed cable, in which interbay cables are preformed in the factory or manufacturing location and then subsequently connected directly to equipment terminals in the field by an installer; (2) bulk cable, in which interbay cables are formed from a bulk cable supply in the field and connected directly to equipment terminals by the installer; (3) connectorized cable, in which equipment local cables are wired to the equipment terminals and provided with connector plugs in the factory, and in which interbay cables also are formed with connector plugs in the factory, with the local cables and the interbay cables subsequently being merely plugged together in the field; and (4) terminal strips having, for example, solderless-wrap or quick-connect terminals, in which the equipment is wired to the terminal strips in the factory, and interbay cables subsequently are formed from a bulk cable supply in the field (as noted hereinabove in method #2) and connected to the terminal strips.

Of the foregoing wiring systems, formed cable (method #1) and bulk cable (method #2) generally are lowest in cost, but require longer installation intervals and extensive activities adjacent to working equipment in the field. These field-wired systems also generally result in lower quality as compared to the factory-wired cables involved in the use of connectorized cables or terminal strips. As between connectorized cable and terminal strips, connectorized cable generally is advantageous because of the short installation interval involved, with the least disruption to existing equipment and services, and because it usually results in the highest overall quality system at the lowest cost. Connectorized cable is also desirable because it facilitates maintenance and relocation or reassociation of equipment. Accordingly, in recent years the use of connectorized cable in the installation of transmission equipment, as well as other types of electrical equipment, has significantly increased. In certain instances, however, connectorized cable is not always practical, as for example where a complex network of transmission equipment bays is to be interconnected. Rather, it then may be preferable to interconnect the equipment bays utilizing bulk cable in association with terminal strips, or to utilize connectorized or other types of prefabricated cable, bulk cable and terminal strips in various combinations with one another.

Heretofore, however, connector plugs for connectorized cable have been designed for use primarily with another mating connector plug, while terminal strips have not been designed for use in combination with connectorized cable. For example, in a connector plug arrangement disclosed in U.S. Pat. No. 3,760,335, issued Sept. 18, 1973 to L. E. Roberts, the wires of two cables which are to be interconnected are secured to quick-connect solderless terminals of respective mating connector housings each having a standard number (e.g., 50) of terminals. After the wires have been connected to the terminals, shields or covers are slid onto the housings over the terminals and the wire portions therein, and the covers and housings are secured together by suitable screws to produce two mating connector plugs. To connect the cables together, the mating connector plugs are then plugged into one another during installation of the equipment in the field. When it is desired to remove, replace or rearrange the connector wires, the covers are disassembled from the housings, and then reassembled thereto when the desired changes have been completed.

Similarly, an example of a known type of terminal strip is disclosed in the U.S. Pat. No. 3,798,587, issued on Mar. 19, 1974 to B. C. Ellis, Jr. et al.. In this patent, one set of wires, such as the wires connected to the terminals of the equipment, are dressed along an elongated insulating block into respective spaced slots in the block. A second elongated insulating block has a row of elongated electrical terminals fixedly mounted therein, with the terminals having quick-connect bifurcated legs at their opposite ends. In use, the bifurcated legs at first ends of the terminals, which project outward from the second insulating block, are connected to the dressed wires in the first insulating block by assembling the two blocks together so that the bifurcated terminal legs receive respective ones of the dressed wires therebetween as the legs are inserted into slots in the first block. A second set of wires, as for example of an interbay cable, then are inserted into respective ones of the bifurcated legs at the other ends of the terminals to establish connections between the two sets of wires. A terminal strip of this same type is also shown in U.S. Pat. No. 3,496,522, issued to B. C. Ellis, Jr. et al. on Feb. 17, 1970, and U.S. Pat. No. 3,611,264, issued to B. C. Ellis, Jr. on Oct. 5, 1971.

The U.S. Pat. No. 3,878,603, issued to L. A. Jensen on Apr. 22, 1975, discloses a solderless cable splicing device of a type similar to the terminal strip in the above-mentioned U.S. Pat. No. 3,798,587, in which two sets of cable wires to be spliced initially are dressed along an elongated first electrically insulating block and fanned into respective slots between longitudinally spaced wire guide portions on opposite sides of the block. An elongated electrically insulating second block, having a plurality of U-shaped terminals mounted thereon with quick-connect bifurcated legs projecting from the block, then is assembled to the first block with the legs of the terminals receiving respective ones of the fanned wires to complete the splice.

Thus a need exists for a versatile electrical conductor terminating system in which a terminal strip assembly is capable of universal use with various types of cable, such as, bulk formed cable on a quick-connect basis and prefabricated cable on a multiwire-connect basis, or various combinations thereof, and the purpose of this invention is to provide such a system which is inexpensive, reliable, capable of accommodating high termination densities, easy to repair and maintain, and readily adaptable to circuit design changes.

SUMMARY OF THE INVENTION

This invention relates to an electrical conductor terminating system which may comprise an electrically insulating support block for electrical terminals having interconnected legs disposed in opposed relationship. The terminal support block includes a body portion and sets of electrical conductor guide portions projecting outward with respect to one side of the body portion in spaced opposed relationship. The guide portions are spaced to define electrical conductor-receiving slots therebetween, and electrical terminal leg-receiving slots are formed in the support block for receiving the legs of the terminals. The terminal leg-receiving slots communicate with at least a portion of their respective conductor-receiving slots, extend from the latter slots to an opposite side of the body portion, and are open-ended adjacent the opposite side of the body portion for the reception of the terminal legs.

More specifically, a terminal strip assembly includes an elongated insulating terminal support block having a body or bight portion and rows of electrical conductor guide portions projecting from one side of the body portion in spaced parallel opposed relationship. A row of U-shaped terminals is mounted on the support block in slots defined by insulating ribs of the support block and each terminal includes bifurcated legs which extend within electrical conductor-receiving slots defined by respective adjacent ones of the guide portions. The terminals are retained in the slots by a terminal retaining member assembled to the terminal support block. Wires may be connected to the terminals on a quick-connect basis in different manners utilizing either bulk cable or various types of prefabricated cable, as desired.

DETAILED DESCRIPTION

Figure 1:
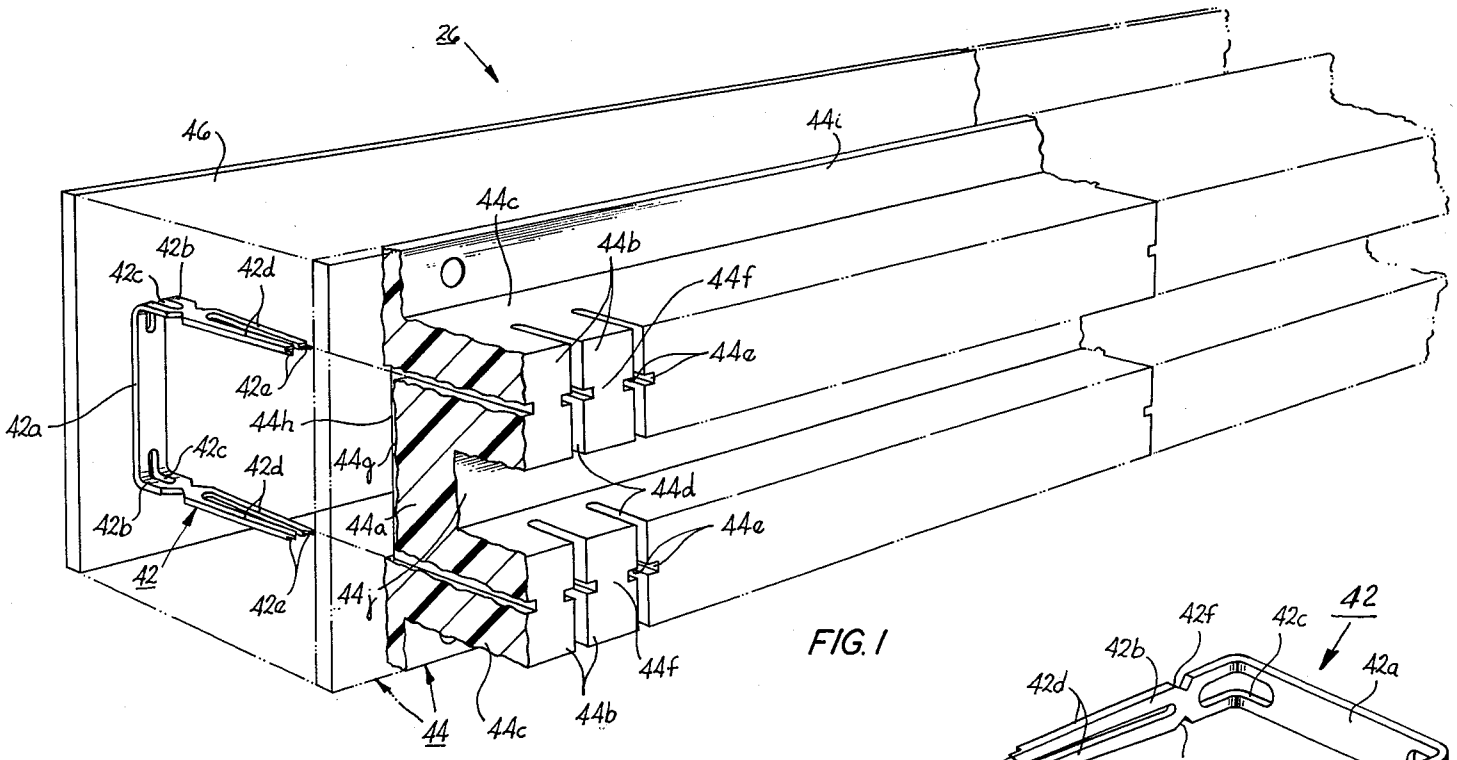
FIG. 1 is a partial isometric exploded view of a terminal strip assembly in accordance with this invention.
Figure 2:
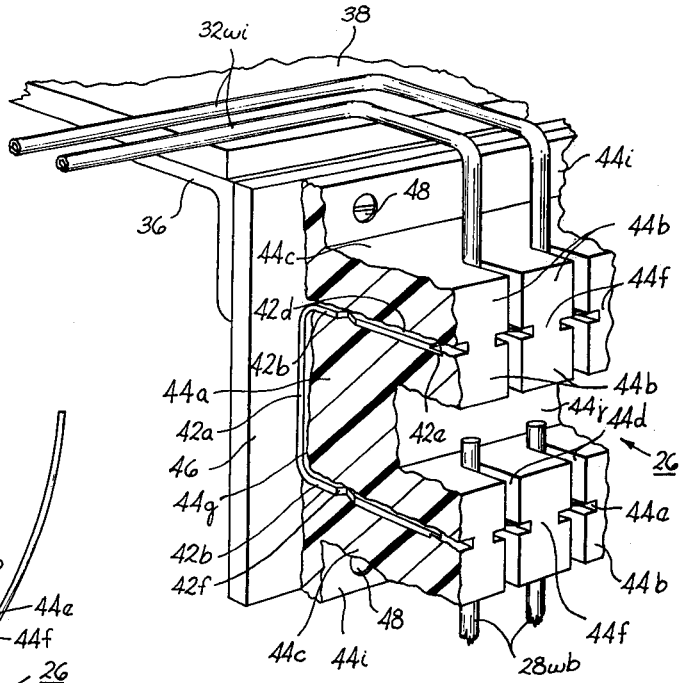
FIG. 2 is a partial isometric view of the terminal strip assembly of FIG. 1 in assembled relationship.
Figure 14:
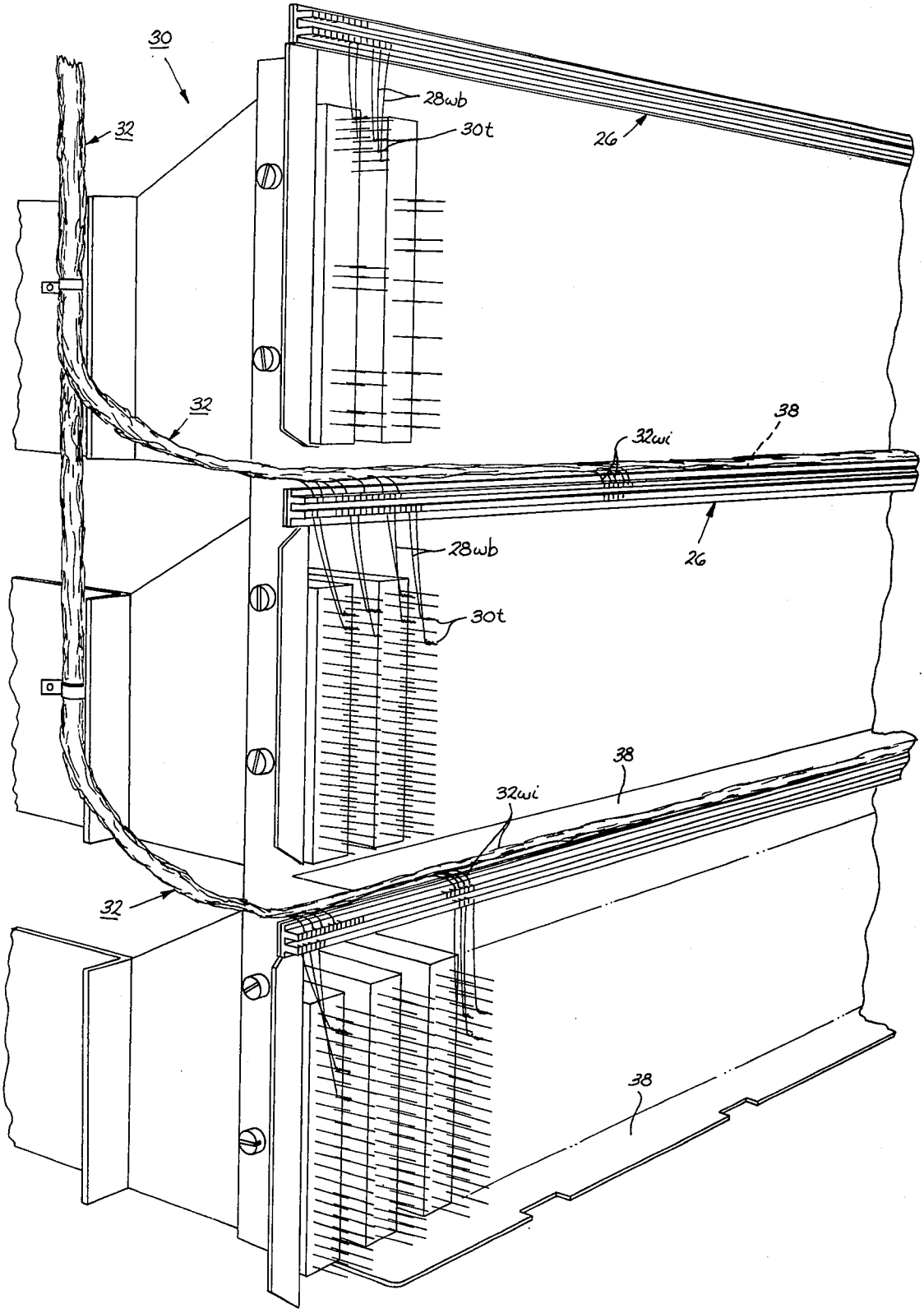
FIG. 14 is a partial isometric view of a communications equipment bay, in which the terminal strip assemblies of FIGS. 1–6 and the prefabricated cables of FIGS. 8, 9 and 11 may be utilized.

Referring to FIG. 14, the disclosed embodiment of the invention is directed to an electrical conductor terminating system in which terminal strip assemblies 26 as shown in detail in FIGS. 1–4 (or 26' as shown in detail in FIGS. 5 and 6) are utilized for the interconnecting of sets of insulated electrical conductor wires, such as sets of insulated electrical conductor wires **28*wb* in a communications equipment bay 30, and sets of insulated electrical conductor wires 32*wi* of one or more interbay cables 32 (only one shown) for connecting the equipment bay to other equipment bays (not shown). The construction of each of the terminal strip assemblies 26 (or 26') is such that the interbay cables 32 may be of a bulk cable type, with each of its wires 32*wi* connected individually or in pairs directly to the terminal strip assemblies on a quick-connect basis in the field as shown in FIGS. 2 and 6. In the alternative, the interbay cables may be a prefabricated type cable 32' (FIG. 8), 32'' (FIG. 9), or 32''' (FIG. 11) which is preformed in the factory and subsequently assembled to the terminal strip assembly 26 or 26' in the field. Each of the terminal strip assemblies 26 may be a continuous integral unit which extends across the entire width of the equipment bay 30 (FIG. 14), or a plurality of the terminal strip assemblies of shorter length may be mounted in end-to-end relationship across the bay, as desired. Each of the terminal strip assemblies 26** also may be cut transversely to provide terminal strip assemblies of different lengths, as desired.

Referring to FIGS. 2, 4 and 14, each of the terminal strip assemblies 26 is suitably mounted on the frame of the equipment bay 30, such as by screws (not shown), to a horizontally extending angle-bar mounting member 36 (FIGS. 2 and 4) also secured by screws (not shown) to a horizontal shelf member 38 of the equipment bay during manufacture of the bay in the factory. At the same time, the equipment bay wiring is formed by connecting first stripped ends of the insulated electrical conductor wires **28*wb* to terminals 30*t* (FIGS. 4 and 14) of the equipment bay (e.g., by solderless wire-wrapping), and connecting second unstripped opposite ends of the wires 28*wb* to respective ones of the terminal strip assemblies 26 on a quick-connect basis, as shown in FIGS. 2 and 4**.

Referring to FIG. 1, the terminal strip assembly 26 includes a row of U-shaped electrical terminals 42, an elongated terminal support block 44 and a terminal retaining plate 46. The terminal support block 44 and the retaining plate 46 both are formed of a suitable electrically insulating material, such as molded plastic, as for example that sold by the General Electric Plastics Business Division of Selkirk, New York under the tradename "Noryl 225."

Figure 3:
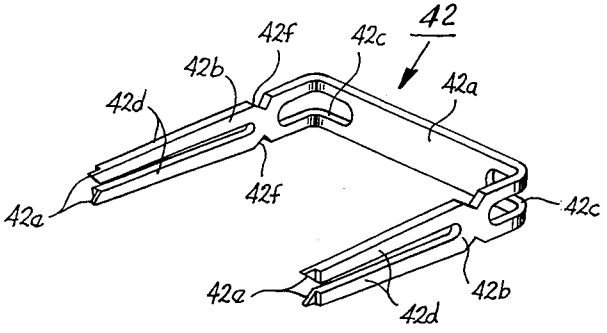
FIG. 3 is an isometric view of a terminal used in the terminal strip assembled of FIG. 1.

As is shown in FIG. 3, each of the terminals 42 is of a quick-connect type having a bight portion 42*a* which interconnects first and second legs 42*b* projecting from one side of the bight portion adjacent its opposite ends. The terminals 42 are formed from an electrically-conducting resilient material, such as phosphorous deoxidized tin bronze in a series of blanking, coining and bending steps, as for example in a progressive punch and die. In this forming operation, the material for each terminal 42 is formed, while in a flat state, with a pair of elongated apertures 42*c* adjacent respective opposite ends of the bight portion 42*a*, to facilitate subsequent bending of the terminal into the U-shaped configuration shown. Each of the legs 42*b* of the terminal 42 also is bifurcated to produce resilient furcations 42*d* having opposed essentially flat edges, and is formed, by blanking and coining, with relatively thin inwardly converging insulation cutting edges 42*e* adjacent its outer end. The thin outer insulation cutting edges 42*e* cause initial cutting through the insulation on a respective one of the insulated electrical conductor wires 28*wb* or 32*wi* (FIG. 2) to establish contact with the wire as it is pressed between the cutting edges, after which the insulation is displaced longitudinally of the wire as it passes between the opposed flat edges of the furcations 42*d*, in a manner disclosed in the U.S. Pat. No. 3,798,587. The spacing between the flat-faced furcations 42*d* is selected so as to be slightly less than the minimum diameter (e.g., 26 gage) of one of the electrical conductor wires 28*wb* or 32*wi* to be utilized, so that a plurality of wire diameters (e.g., from 22 gage to 26 gage) can be accommodated by the terminal. This ability of the furcations 42*d* to receive wires 28*wb* or 32*wi* of various diameters, without severing the wire, is achieved as a result of the opposed edges of the furcations being flat, and by forming notches 42*f* in the outer edges of the terminal legs 42*b* to facilitate flexing of the furcations as the wire is inserted therebetween.

In the disclosed embodiment of the invention, the terminal support block 44 (FIGS. 1 and 2) includes a transversely extending bight or body portion 44*a*. First and second rows or sets of insulated electrical conductor wire guide portions 44*b*, which are formed in outer portions of legs 44*c* projecting outward from one side of the bight portion 44*a* in spaced parallel opposed relationship, are spaced longitudinally to define electrical conductor wire-receiving slots 44*d* therebetween of substantial depth in comparison to the spacings between the guide portions. The wire guide portions 44*b* also have pairs of opposed slots 44*e*, separated by rib portions 44*f*, formed in opposed walls of each of the wire-receiving slots 44*d* (and thus in communication therewith) for the reception of respective ones of the legs 42*b* of the terminals 42 in opposed face-to-face relationship, as shown in FIG. 2. The opposed slots 44*e* extend from the wire-receiving slots 44*d* within the bight portion 44*a* to the opposite side thereof, and merge adjacent inner open ends (left-hand as viewed in FIGS. 1 and 2) with opposite ends of respective transverse slots 44*g* in the bight portion. The transverse slots 44*g* are separated by rib portions 44*h* (one shown in FIG. 1) and receive the bight portions 42*a* of the terminals 42 in spaced insulated relationship. Preferably, the width of the wire-receiving slots 44*d* is slightly less than the diameter of the insulation on the insulated wires 28*wb* or 32*wi* so that the wire guide portions 46*b* grip the insulation to produce an inherent strain relief which prevents the wires from pulling out of the slots when the wires are mounted therein.

In mounting the terminals 42 on the support block 44, the legs 42*b* of the terminals are positioned in the slots 44*e* in the support block as shown in FIG. 2. More specifically, each terminal leg 42*b* is received in its respective set of opposed slots 44*e* in the adjacent wire guide portions 44*b*, with the furcations 42*d* of the leg located adjacent opposite sides of the wire-receiving slot 44*d* defined by the wire guide portions, for the reception of one of the insulated electrical conductor wires 28*wb* or 32*wi*. The insulation cutting edges 42*e* of each terminal leg 42*b* also are recessed (FIG. 2) with respect to the outer ends of the adjacent wire guide portions 44*b*, so that the leg is protected against bending or other physical damage from external sources, or from inadvertent electrical contact which could cause service interruption during use.

With further reference to FIGS. 1 and 2, the bight portion 42*a* of each of the terminals 42 seats in its respective slot 44*g* in the bight portion 44*a* of the support block 44 as noted above. The size of the slots 44*e* and 44*g* with respect to the terminals 42 is such that the terminals 42 are retained in spaced insulated relationship with a slight freedom of lateral movement, so that the terminals are, in effect, self-centering in their respective slots 44*e* as the insulated electrical conductor wires 28*wb or 32wi* are pushed downward in the slots and into the legs 42*b* of the terminals. The terminal 42 are held in the support block 44 in their respective slots 44*e* and 44*g* so as to be readily replaceable, by the retaining plate 46 as shown in FIG. 2, which is suitably secured to the support block, such as by screws 48 (FIGS. 2 and 4) extending through side flanges 44*i* of the support block into the terminal retaining plate.

Figure 4A:
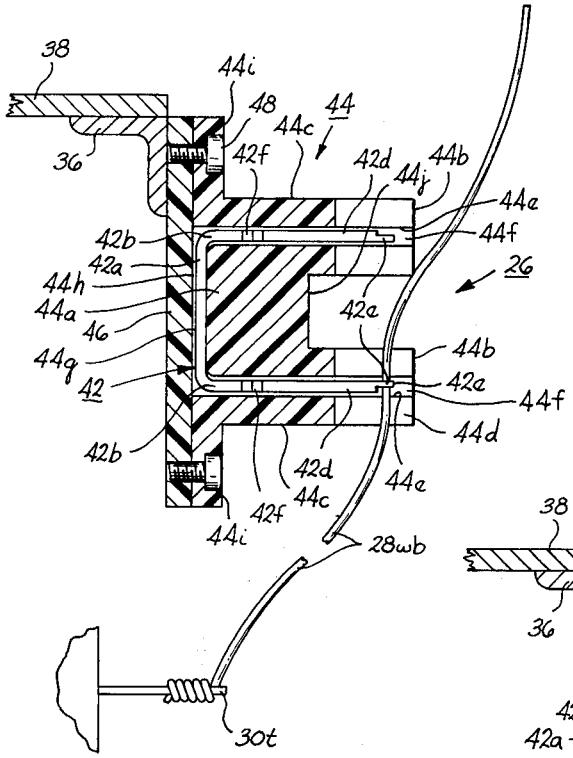
FIG. 4A is a transverse cross-sectional view of the terminal strip assembly of FIGS. 1 and 2, illustrating a first step in the connecting of a wire to the terminal strip assembly.
Figure 4B:
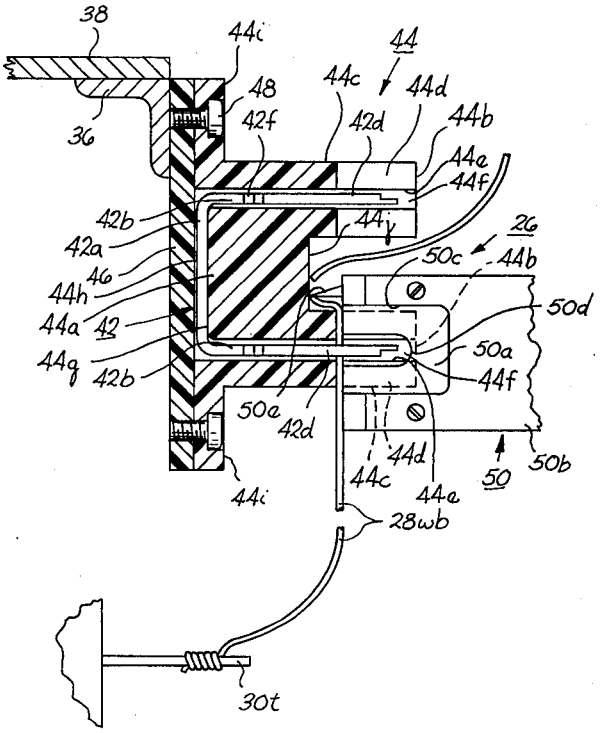
FIG. 4B is a transverse cross-sectional view as shown in FIG. 4A, illustrating one manner of seating the wire in the terminal strip assembly.
Figure 13:
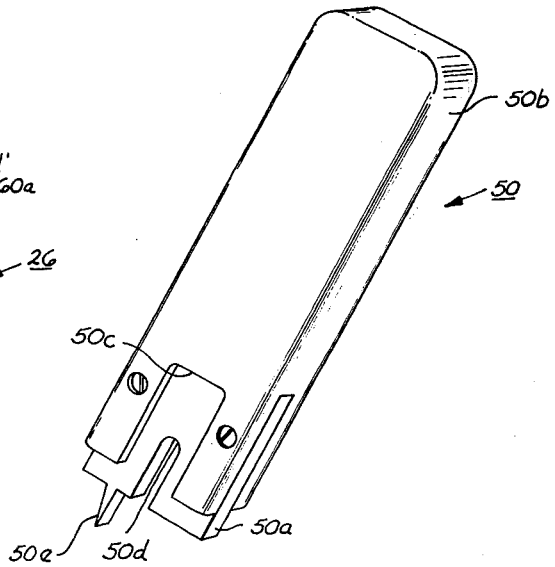
FIG. 13 is an isometric view of a hand tool for seating wires in the terminal strip assemblies of FIGS. 1–6.

In wiring one of the terminal strip assemblies 26 in the factory, the insulated wires 28*wb* of the equipment bay 30 (FIG. 14) initially are positioned in the outer portions of their respective slots 44*d* between the wire guide portions 44*b*, with a short excess portion (several inches) of each wire extending above the guide portions, as shown by one of the wires in FIG. 4A. Each insulated wire 28*wb* then may be pushed or seated in its respective slot 44*d* and simultaneously cut to length as illustrated in FIG. 4B, by the aid of a suitable tool 50 as shown in FIG. 13.

For this purpose, the tool 50 includes a wire seating blade 50*a* secured in a slot in one end of a molded plastic handle 50*b* by suitable screws. During the seating of the insulated wire 28*wb* in the bottom of the slot 44*d*, guide grooves 50*c* in the plastic handle 50*b* on opposite sides of the seating blade 50*a*, and a slot 50*d* in the seating blade, receive the adjacent wire guide portions 44*b* of the terminal support block 44, and the furcations 42*d* of the terminal leg 42*b* which is in the slot 44*d*, respectively, to permit the seating of the wire to take place. As the wire 28*wb* is seated, a wire cutting portion 50*e* of the seating blade 50*a* presses the wire against a central channel surface 44*j* of the terminal support block 44, with the channel surface acting as an anvil, to cut the wire to length, as illustrated in FIG. 4A. At the same time, the insulation of the wire 28*wb* is severed by the insulation cutting edges 42*e* and the terminal furcations 42*d* to establish electrical contact with the wire, as above described.

In the field, the insulated wires 32*wi* (FIGS. 2 and 14) of the associated interbay cable 32 (FIG. 14) may be connected to their respective terminal legs 42b in the terminal strip assembly 26 in the same manner. In the alternative, the insulated wires 28wb *or* 32wi may be seated with a non-shearing tool (not shown) and the excess portions of the insulated wires then trimmed off by scribing a suitable wire cutting tool or knife (not shown) over the central channel surface 44j along the length thereof. If desired, a plurality of the wires 28wb or 32wi also may be seated (and cut to length) by a suitable multi-wire engaging tool (not shown). Further, when a wiring change is required, since the wires 28wb and 32wi are on the same side of the terminal strip 26, the wires are readily accessible, and the involved wires 28wb and/or 32wi can readily be removed from the terminal furcations 41d of their respective terminal legs 42b and reinserted in terminal furcations of different ones of the terminals 42, as required.

Figure 5:
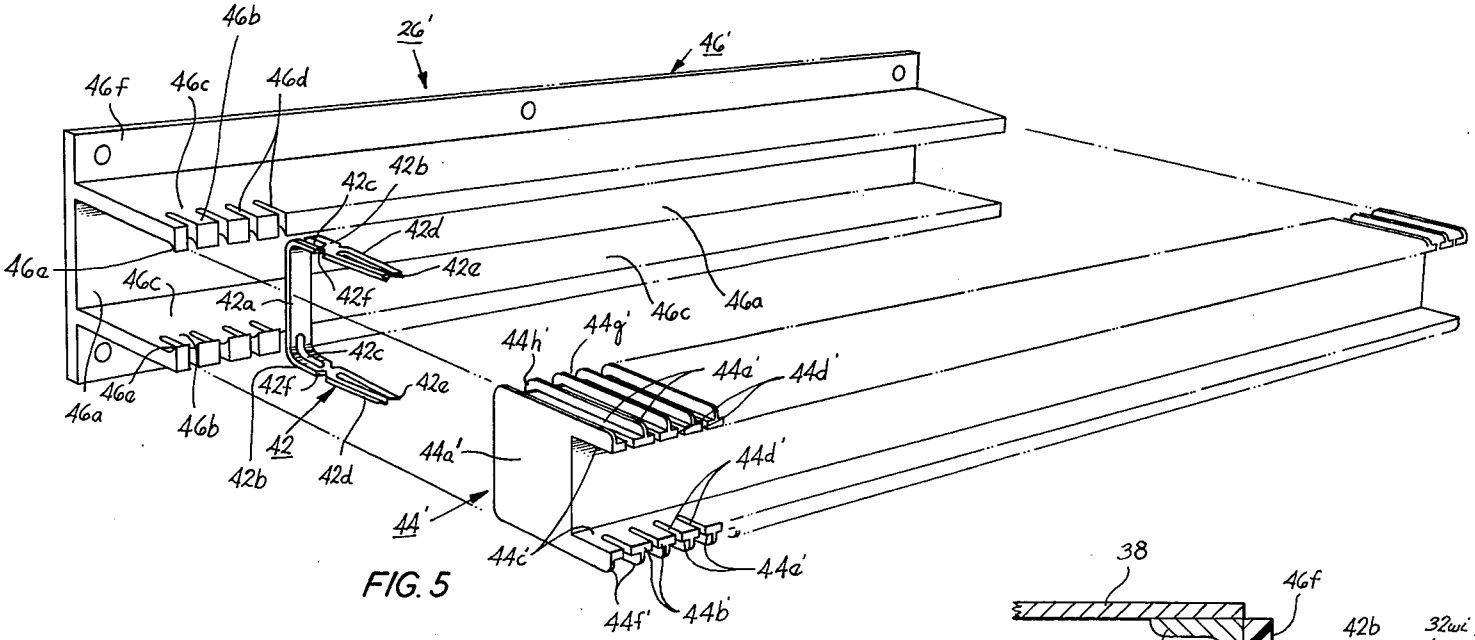
FIG. 5 is a partial isometric exploded view of another terminal strip assembly in accordance with this invention.
Figure 6:
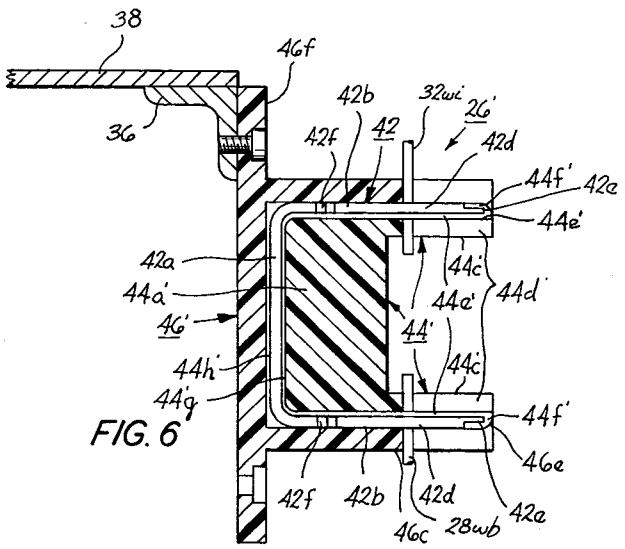
FIG. 6 is a transverse cross-sectional view of the terminal strip assembly of FIG. 5 in assembled relationship.

Referring to FIGS. 5 and 6, the terminal strip assembly 26' also includes a row of the U-shaped terminals 42, an elongated terminal support block 44' and a terminal retaining member 46'. The terminal support block 44' and the terminal retaining member 46' both are formed of a suitable electrically insulating material subh as the molded plastic ("Noryl 225") indicated hereinabove for the terminal support block 44 and terminal retaining plate 46 shown in FIGS. 1–4.

The terminal support block 44' has an essentially U-shaped configuration and includes a transversely extending bight or body portion 44a'. First and second rows or sets of insulated electrical conductor wire guide portions 44b', which are formed in outer portions of first and second side legs 44c' projecting outward from one side of the bight portion 44a' in spaced parallel opposed relationship, are spaced longitudinally to define electrical conductor wire-receiving slot 44d' therebetween. The bight portion 44a' and the side legs 44c' also have a series of slots 44e'formed in outer surfaces thereof and separated by ribs 44f' so that portions of the slots extend on opposite sides of each of the wire-receiving slots 44d'(and thus in communication therewith), for the reception of respective ones of the legs 42b of the terminals 42 in opposed face-to-face relationship. The slots 44e' extend along the outside of the bight portion 44a' and the legs 44c', from the wire-receiving slots 44d' to the opposite side of the bight portion, and merge at inner open ends (left-hand, as viewed in FIG. 5) with opposite ends of respective transverse slots 44g' in the bight portion. The insulating ribs 44f' similarly merge with transverse insulating ribs 44h', whereby the transverse slots 44g' receive the bight portions 42a of the terminals 42 between the ribs in insulated spaced relationship.

The terminal retaining member 46' has an essentially U-shaped configuration with a transversely extending bight portion 46a and rows of electrical conductor wire guide portions 46b formed in outer portions of side legs 46c projecting from the bight portion in spaced parallel opposed relationship. The electrical conductor wire guide portions 46b are separated by a series of slots 46d such that the guide portions and the slots will be aligned with corresponding ones of the electrical conductor wire guide portions 44b' and the slots 44d' of the terminal support block 44' when the retaining member 46' and the support block are assembled together. In this connection outer edges of the guide portions 46b of the terminal retaining member 46' include slightly inturned lips 46e which engage over rounded outer ends of the adjacent insulating ribs 44f' of the terminal support block 44' to hold the retaining member and the support block in quick-releasable assembled relationship, thus permitting ready disassembly of the members for replacement of the terminals 42. At least one side of the terminal retaining member 46' also includes a mounting flange 46p for supporting the assembled terminal retaining member and terminal support block 44' on the frame of the equipment bay 30 (FIG. 14), such as on the shelf 38 by means of the angle mounting bar 36 and suitable screws, as shown in FIG. 6.

Figure 7:
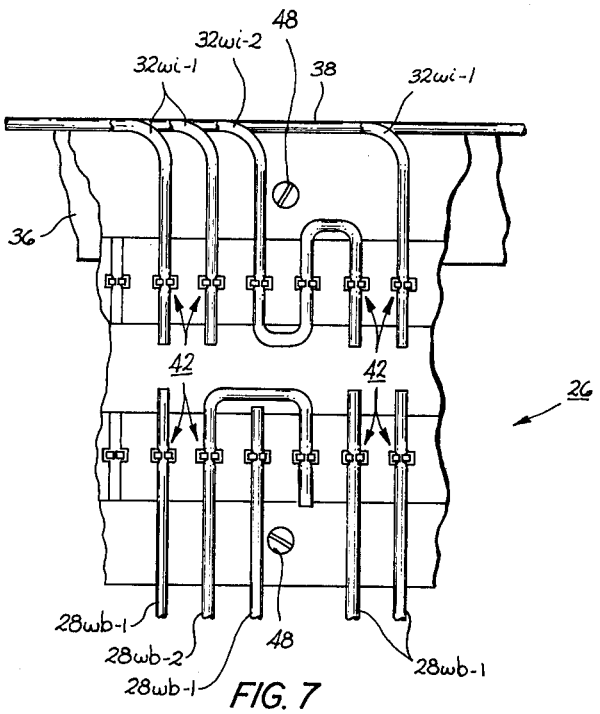
FIG. 7 is a plan view of a portion of the terminal strip assembly of FIGS. 1–4, illustrating various modes of connecting wires to the terminal strip assemblies of FIGS. 1–6.

FIG. 7 discloses a portion of one of the terminal strip assemblies 26 (FIGS. 1–4) to illustrate, by way of example, the flexibility of the terminal strip assemblies 26 and 26' (FIGS. 5 and 6) from the standpoint of connecting the insulated cable wires 28wb and 32wi to the terminals 42 thereof. Thus, wires designated 28wb-1 and 32wi-1 may be connected to respective ones of the terminals 42 and cut to length as described hereinabove. Another wire designated 28wb-2 may be connected to a pair of the terminals 42 on opposite sides of a terminal connected to one of the wires 28wb-1, as shown adjacent the lower center of the figure. Similarly, a wire designated 32wi-2 may be connected to a series of three of the terminals 42 in a serpentine fashion, as shown adjacent the top center of the figure. It is apparent that other wire connecting arrangements may be utilized as desired.

Figure 8:
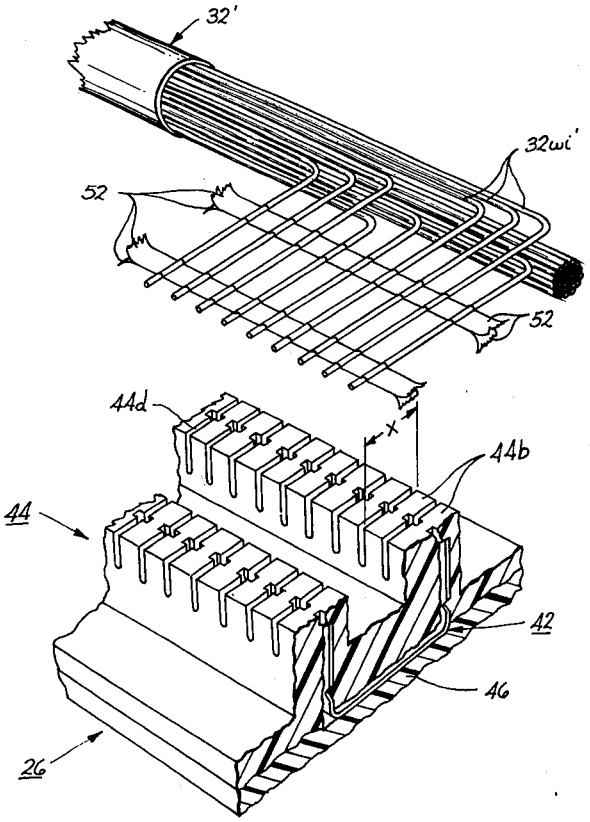
FIG. 8 is an isometric view illustrating a prefabricated cable which may be utilized with the terminal strip assemblies of FIGS. 1–6.

Referring to FIG. 8, the prefabricated interbay cable 32' is formed by initially desheathing a length of the cable at one end thereof. The desheathed wires 32wi' of the cable 32' then are fanned in a preselected array corresponding to the desired positions of the wires in the wire-receiving slots 44d or 44d' of the terminal strip assemblies 26 and 26', at right angles to the longitudinal axis of the cable in a suitable fanning fixture (not shown) into a spatial relationship corresponding to the spaced relationship of the wire-receiving slots. With reference to the terminal strip assembly 26 in FIG. 8, spaced sets of flexible wire-retaining strips 52, in the form of opposed adhesive tapes or lengths of plastic material (e.g., polyethylene) on opposite (e.g., upper and lower) sides of the wires 32wi', then are applied to the wires in a spaced relationship slightly greater then a dimension "X" of the electrical conductor wire guide portions 44b of the terminal strip assembly, to maintain the wires in their desired spatial positions.

For example, this may be accomplished by fanning the wires 32wi' into their spatial preselected relationship over the lower wire-retaining strips 52 in the aforementioned fanning fixture, after which the upper wire-retaining strips 52 may be applied over the wires and the lower wire-retaining strips. Where the wire-retaining strips 52 are plastic they may be heat sealed to one another between the wires 32wi' by a suitable bonding device, also not shown. The wires 32wi' may be interconnected by the strips 52 in a continuous string, or in groups by separate sets of the strips 52 to facilitate handling, as desired.

Subsequently, in assembling the wires 32wi' to one of the terminal strip assemblies 26 (or 26') in the field, the wires are positioned on the terminal strip assembly so that the associated wire guide portions 44b are received between the spaced wire-retaining strips 52, whereupon the wires can be seated in the terminal strip assembly as above described. The left-hand set of retaining strip 52, as viewed in FIG. 8, and the severed portions of the wires 32wi' interconnected thereby, then are discarded.

The other set of retaining strips 52 may be removed from the wires 32*wi'*, or left in place thereon, as desired.

Figure 9:
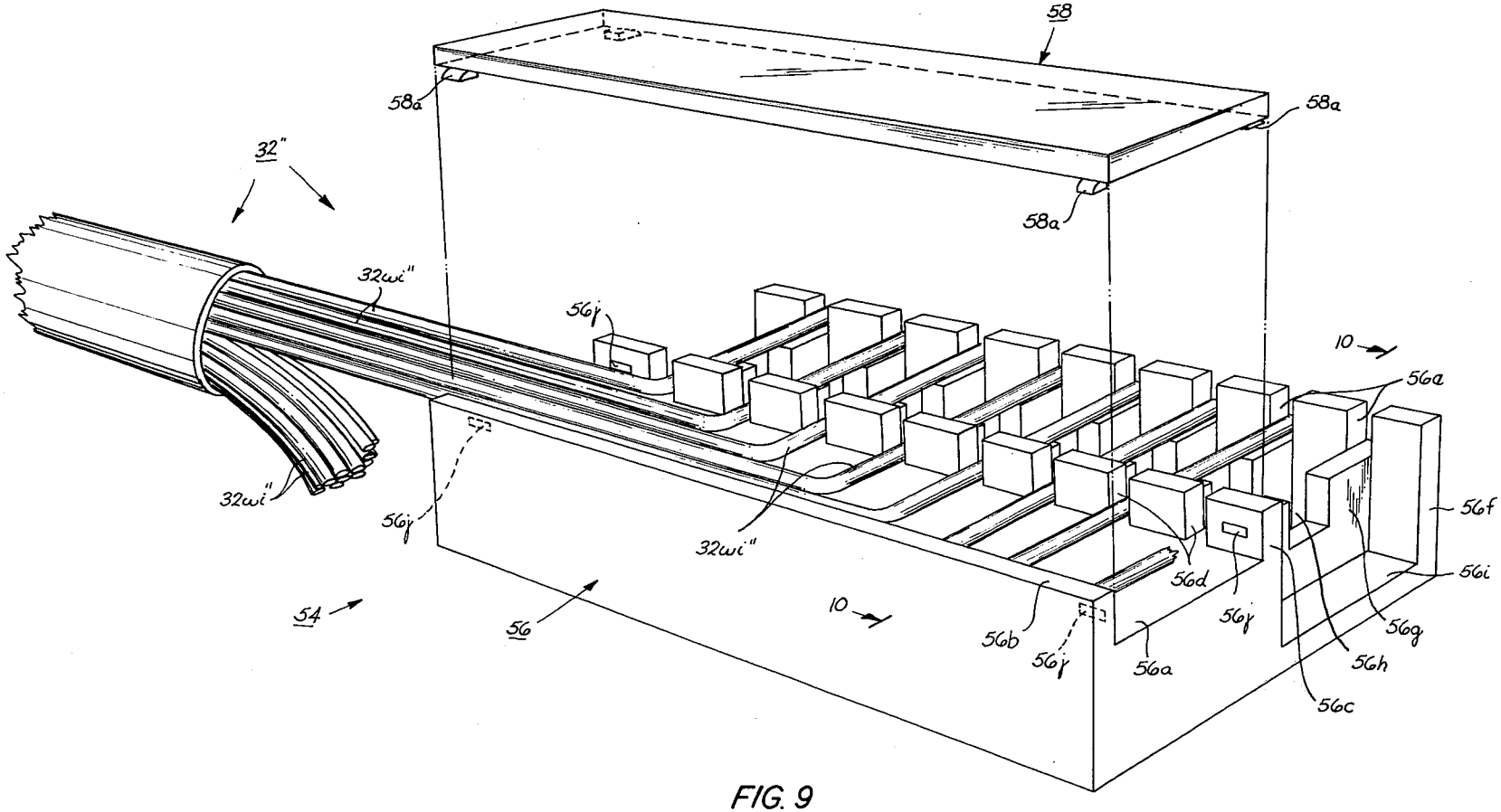
FIG. 9 is an isometric view illustrating another prefabricated cable which utilizes a wire carrier-and-seating device.

Referring to FIG. 9, the prefabricated cable 32'' is formed utilizing a plurality of wire carrier-and-seating devices 54 (only one shown) consisting of a molded plastic wire support block or housing 56 and a snap-on molded plastic wire-retaining cover member 58. Initially, desheathed portions of a group of the wires 32*wi''* of the cable 32'' are dressed along the bottom of a first elongated channel 56*a* in the wire support block 56 and having sides defined by a first outer wall 56*b* and an intermediate wall 56*c* of the wire support block. In this connection, the number of the wires 32*wi''* shown in FIG. 9 are solely for purposes of illustration, and it is apparent that the wire carrier-and-seating device 54 may be constructed to accommodate additional wires arranged in one or more layers in the channel 56*a*, as desired.

The wires 32*wi''* then are dressed in a preselected array at right angles to the longitudinal axis of the cable 32'', through respective ones of a series of aligned slots 56*d* and 56*e* formed in the intermediate wall 56*c* and a second outer wall 56*f*, respectively, of the wire support block 56. The wires 32*wi''* are supported between the slots 56*d* and 56*e* on top surfaces of spaced ribs 56*g* extending between the intermediate wall 56*c* and the second outer wal 56*f*, with each wire in bridging relationship across a slot 56*h* formed in its respective rib for a purpose to be described. As is apparent from FIG. 9, the intermediate wall 56*c* and the second outer wall 56*f* define a second elongated channel 56*i* extending parallel to the first elongated channel 56*a*, and in which the ribs 56*g* are located.

After being positioned in the wire support block 56 as above described, the wires 32*wi''* preferably are cut substantially flush with the outside of the second outer wall 56*f*. The snap-on wire-retaining cover 58, which has resilient latching lugs 58*a* adjacent its corners and receivable in mating recesses 56*j* in the outer wall 56*b* and the intermediate wall 56*c*, is releasably mounted on the support block 56 over the portions of the wires 32*wi''* in the channel 56*a* to retain the wires in position during shipment from the factory for installation in the field. A similar cover may be provided for the portions of the wires 32'' in the channel 56*i*, if so desired. The remaining wires 32*wi''* of the cable 32'' may be connected in groups at the same or at successive locations along the cable, to respective ones of the wire carrier-and-seating devices 54 in the same manner.

Figure 10A:
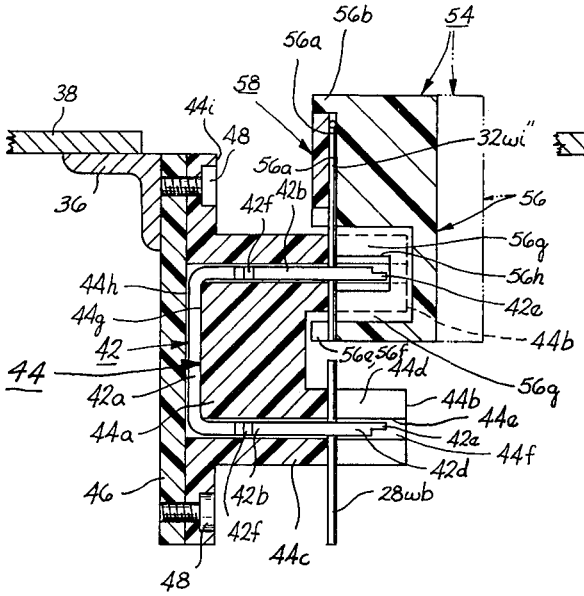
FIGS. 10A and 10B are cross-sectional views, as seen in the direction of the arrows 10—10 in FIG. 9, illustrating the manner in which the prefabricated cable shown in FIG. 9 is connected to the terminal strip assemblies shown in FIGS. 1–6.

In the connection of the wires 32*wi''* to one of the terminal strip assemblies 26 (or 26') in the field, referring to FIG. 10A, the wire support block 56 of each of the wire holding-and-seating devices 54 is positioned on the terminal support block 44 of the terminal strip assembly as indicated in broken lines so that the wire guide portions 44*b* of the terminal support block are received between the ribs 56*g* of the wire support block and so that the portions of the wires (only one shown in FIG. 10A) supported on the ribs are received in respective wire-receiving slots 44*d* of the terminal support block. The wire support block 56 then is pushed onto the terminal strip assembly 26 as shown in solid lines in FIG. 10A, either manually or with a suitable power tool (not shown), to seat all of the wires 32*wi''* in the wire support block simultaneously.

Figure 10B:
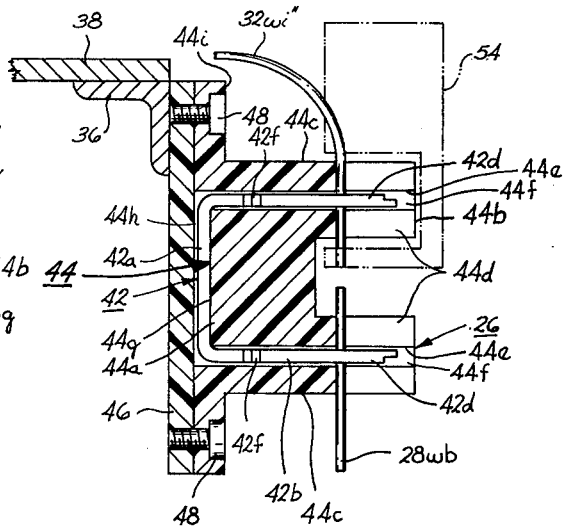

During the seating of the wires 32*wi''*, the furcations 42*d* of the terminals 42 in the terminal strip assembly 26 are received in the slots 56*h* in the ribs 56*g* of the wire support block 56 to permit the seating of the wires to occur. After the wires 32*wi''* have been seated, the releasably mounted wire-retaining cover 58 is removed from the wire support block 56, permitting the wire support block 56 to be removed from the seated wires and the wires to be suitably dressed along the equipment bay shelf 38, as illustrated in FIG. 10B. In this regard, the wire-receiving slots 56*d* and 56*e* of the wire support block 56 are wider than the diameter of the wires 32*wi''*, while the slots 44*d* and 44*d'*, 46*d* of the terminal strip assemblies 26 and 26' receive the wires with a tight fit as noted hereinabove, thus permitting the latter slots to hold the wires in place when the wire support block is removed.

Figure 11:
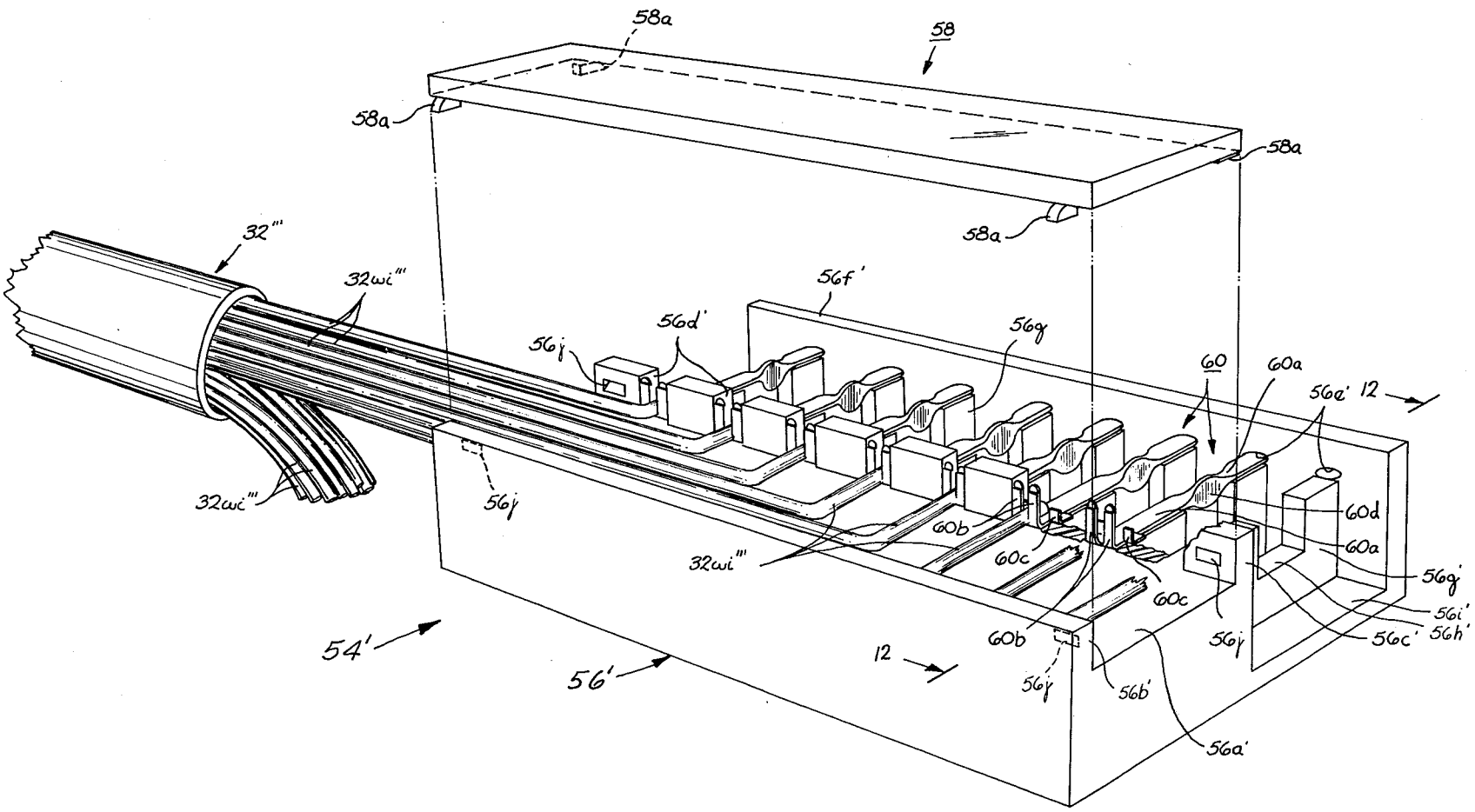
FIG. 11 is an isometric view illustrating a prefabricated connectorized cable which may be utilized with the terminal strip assemblies of FIGS. 1–6.

The prefabriated connectorized cable 32*wi'''*in FIG. 11 utilizes a plug assembly 54' of substantially the same construction as the wire carrier-and-seating devices 54 shown in FIG, 9, except that a wire support block 56' is provided with apertures 56*e'* in an outer wall 56*f'* thereof, instead of with the slots 56*e* in the corresponding outer wall 56*f* of the wire support block 56. As in the case of the wire carrier-and-seating device 54, the wires 32*wi'''* are dressed in a channel 56*a'* of the wire support block 56' having sides defined by an outer wall 56*b'* and an intermediate wall 56*c'* of the wire support block. In forming the cable 32''', however, the wires 32*wi'''* of the cable are connected to suitable elongated electrical contact terminals 60 which are mounted in the wire support block 56' in slots 56*d'* in the intermediate wall 56*c'* and on ribs 56*g'* of the wire support block. The terminals 60 are received on the ribs 56*g'* in bridging relationship to slots 56*h'* in the ribs, and extend across a second channel 56*i'* of the support block, with outer ends of the terminals received in the apertures 56*e'* in the outer wall 56*f'* in tight-fitting engagement. A cover member 58 identical to that used in the wire carrier-and-seating device 54 then is mounted on the wire support block 56' to cooperate with the walls of the apertures 56*e'* to retain the wires 32*wi'''* and the contact terminals 60 in position in the wire support block. Thus, referring to FIG. 12, the contact terminals 60 are capable of being inserted into and removed from the furcations 42*d* of the U-shaped terminals 42 in one of the wire strip assemblies 26 on a repeatable basis, whereby the modified wire support block 54' and the wire retaining cover 58 can be utilized as a repeatable type connector plug.

Figure 12:
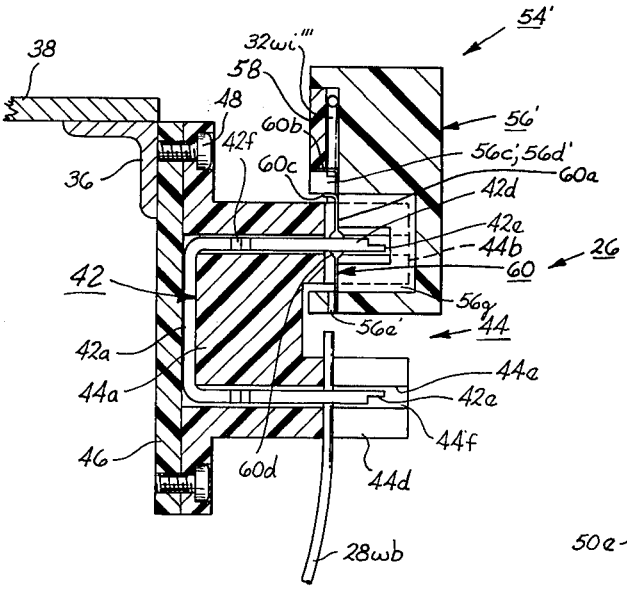
FIG. 12 is a cross-sectional view, as seen in the direction of the arrows 12—12 in FIG. 11, showing the connectorized cable of FIG. 11 connected to the terminal strip assembly of FIGS. 1–4.

In the illustrated embodiment of the invention, each of the electrical contact terminals 60 includes an elongated body 60*a* of rectangular cross-section and having a bifurcated portion 60*b* (similar to that defined by the furcations 42*d* of the terminal 42 in FIG. 3) projecting perpendicularly from an end of the body which is disposed in an associated one of the slots 56*d'* of the wire support block 56'. A pair of upstanding (as viewed in FIG. 11) resilient lugs 60*c* are formed on opposite sides of the body 60*a* and bear against the intermediate wall 56*c'* of the wire support block 56' to retain the contact terminal 60 seated in its respective aperture 56*e'* in the outer wall 56*f'* of the wire support block. To facilitate insertion of the contact terminals 60 into the furcations 42*d* of the terminal 42, each terminal has a flattened or coined central portion 60*d* intermediate its ends adjacent its associated terminal-receiving slot 56*h'* in the wire support block 56', the coined portions being receivable in the terminal furcations when the connector plug assembly 54' is mounted on the terminal strip assembly 26 as shown in FIG. 12. As in the case of the terminals 42 in the terminal support block 44 and 44'

(FIGS. 1–6), the various parts (e.g., outer end of body 60*a* and bifurcated portion 60*b*) of the terminals 60 are recessed in the wire holding block 56′ to preclude bending of, or inadvertent electrical contact with, the terminals. As in the case of the terminals 42, the contact terminals 60 also may be formed in a series of blanking, bending and coining steps, as for example, in a progressive punch and die.

While in the terminal strip assemblies 26 and 26′ disclosed in the drawings, the terminals 42 are arranged in the terminal strip assemblies in a row in spaced side-by-side relationship, it also is considered within the purview of the invertion to mount U-shaped terminals in a terminal strip assembly in a row in spaced end-to-end relationship. In this arrangement, a support block of the terminal strip assembly includes a single elongated row of spaced wire guide portions and associated terminal leg-receiving slots, with each adjacent pair of the leg-receiving slots receiving the legs of a respective one of the U-shaped terminals. Further, each of the U-shaped terminals preferably is formed with its bight portion and bifurcated legs in the same common plane to facilitate the connecting of wires to the bifurcated terminal legs from opposite sides of the terminal strip assembly. As in the case of terminal strip assemblies 26 and 26′, the terminals are retained on the support block by a retaining member secured to the support block and similar in construction to the retaining member 46 of the terminal strip assembly 26. In practice, however, a terminal trip assembly of the type shown by the terminal strip assemblies 26 and 26′, wherein the terminals 42 are in side-by-side relationship, is preferred because of the greater terminal density capacity (i.e., terminals per unit of length) of these terminal strip assemblies.

In summary, a new and improved electrical conductor terminating system has been provided in which electrical apparatus, such as the communications equipment bay 30 (FIG. 14), can be installed in the field utilizing the terminal strip assemblies 26 (FIGS. 1–4) or 26′ (FIGS. 5 and 6) and bulk cable, such as the interbay cable 32, on a single or paired wire quick-connect basis. In the alternative, the equipment bay 30 can be installed in the field utilizing the terminal strip assemblies 26 or 26′ and interbay cable which has been prefabricated in the factory, such as the interbay cable 32′ (FIG. 8) or 32″ (FIG. 9), either of which permit ready positioning and seating of their wires 32*wi*′ or 32*wi*″ in respective ones of the terminals 42, with the wire carrier-and-seating device 54 of the cable 32″ providing a means by which the wires of the cable can be seated simultaneously. The terminal strip assemblies 26 or 26′ also can be utilized with connectorized cable, such as the interbay cable 32‴ (FIG. 11) which has been fabricated to the connector plug assembly 54′ in the factory, with the connector plug assembly subsequently being merely plugged to a respective one of the terminal strip assemblies in the field, as shown in FIG. 12. Various combinations of these different wiring methods in association with the equipment bay 30 also may readily be utilized, if so desired. In either instance, the wires 28*wb* can readily be fabricated to the terminal strip assemblies 26 or 26′ on a quick-connect basis as illustrated in FIG. 4.

In addition to the versatility of the terminal strip assembly 26 or 26′, wherein it can be readily utilized with either bulk-type or prefabricated cable, the terminal strip assembly, consisting only of the molded terminal support block 44 and molded terminal retaining member 46, and the row of associated U-shaped quick-connect terminals 42, may be readily fabricated and assembled at low cost. Further, bending or other physical damage to the terminals 42 (FIGS. 1–6) or 60 (FIGS. 11 and 12) from external sources, or inadvertent electrical contact with the terminals which could cause service interruption during use, is precluded as a result of the terminals being recessed within their respective support blocks 44, 44′ and 56′. The terminal strip assembly 26 or 26′ also is capable of accommodating high termination densities as a result of the close spacing of the terminals 42 which can be achieved in the terminal support block 44 or 44′. Further, removal and replacement of the wires 28*wb*, 32*wi*, 32*wi*′ or 32*wi*″, in the quick-connect terminals 42 of the terminal strip assemblies 26 or 26′, or removal and replacement of the wires 32*wi*‴ in the connector plug assemblies 54′ for repair or rewiring purposes, and/or replacement of the terminals 42 and 60, can readily be accomplished.

What is claimed is:

1. An electrically insulating terminal support block for electrical terminals each having interconnected legs disposed in spaced opposed relationship, which comprises:

a body portion;

sets of electrical conductor guide portions projecting outward with respect to one side of said body portion such that said guide portions and surface portions of the one side of said body portion between said guide portions define a channel between said guide portions;

said sets of electrical conductor guide portions being in spaced opposed relationship on opposite sides of the channel defined by said guide portions and the surface portions of the one side of said body portions;

each of said electrical conductor guide portions being spaced from adjacent guide portions to define electrical conductor-receiving slots therebetween of substantial depth in comparison to the spacings between the guide portions; and electrical terminal leg-receiving slots formed in the support block for receiving the legs of the electrical terminals, the leg-receiving slots being formed in part in opposed walls of respective ones of the electrical conductor-receiving slots defined by the spaced electrical conductor guide portions, extending from the electrical conductor-receiving slots to an opposite side of said body portion, and being open-ended adjacent the opposite side of said body portion for the reception of the legs of the terminals with one leg of each terminal entering one of the leg-receiving slots on one side of said channel and the other leg entering one of the leg-receiving slots on the other side of said channel.

2. An electrically insulating terminal support block as recited in claim 1, in which:

said sets of said electrical conductor guide portions are arranged in elongated parallel rows.

3. An electrically insulating terminal support block as recited in claim 1, in which:

the terminal leg-receiving slots in the opposed walls of the electrical conductor-receiving slots are defined in part by a plurality of spaced insulating ribs in said electrical conductor guide portions.

4. An electrically insulating terminal support block as recited in claim 3, wherein the legs on each of the electrical terminals are interconnected by a bight portion, and which further comprises:

a plurality of spaced insulating ribs on said body portion defining slots for receiving the terminal bight portions.

5. A terminal assembly, which comprises:

an electrically insulating terminal support block including a body portion and a plurality of electrical conductor guide portions projecting outward with respect to one side of the body portion such that said guide portions and surface portions of the one side of said body portion between said guide portions define a channel between said guide portions;

each of said guide portions being spaced from adjacent guide portions to define electrical conductor-receiving slots therebetween of substantial depth in comparison to the spacings between the guide portions; and said electrical conductor guide portions being in opposed spacing relationship on the opposite sides of the channel defined by said guide portions and the surface portions of the one side of said body portion;

electrical terminal leg-receiving slots formed in said support block for receiving legs of electrical terminals, the terminal leg-receiving slots being formed in part in opposed walls of respective ones of the electrical conductor-receiving slots defined by the spaced electrical conductor guide portions, extending from the electrical conductor-receiving slots to an opposite side of the body portion of said support block, and being open-ended adjacent the opposite side of the body portion for the reception of the legs of the terminals; and spaced electrical terminals mounted on said support block, each of said terminals including legs interconnected by a bight portion and disposed in opposed relationship;

the legs of the terminals being located in the electrical terminal leg-receiving slots in said support block with each leg of each terminal located in part in a respective one of the electrical conductor-receiving slots defined by the spaced electrical conductor guide portions for engagement by an electrical conductor when the conductor is inserted in the conductor-receiving slot, and with one leg of each terminal being located in one of the leg-receiving slots on one side of said channel and the other leg being located in one of the leg-receiving slots on the other side of said channel.

6. A terminal assembly as recited in claim 5, which further comprises:

an electrically insulating member mounted on said terminal support block in engagement with the bight portions of said terminals to retain said terminals on said support block.

7. A terminal assembly as recited in claim 5, in which:

said electrical conductor guide portions project outward with respect to the one side of the body portion in spaced substantially parallel opposed sets of said guide portions; and the legs of each terminal are located in their respective conductor-receiving slots in respective ones of the sets of said guide portions.

8. A terminal assembly as recited in claim 7, in which:

the legs of said terminals include outer ends which are recessed with respect to outer ends of said electrical conductor guide portions.

9. A terminal assembly as recited in claim 7, in which:

said sets of said electrical conductor guide portions are arranged in elongated parallel rows.

10. A terminal assembly as recited in claim 9, in which:

said electrical terminals are substantially U-shaped;

the legs of said electrical terminals include bifurcated outer ends located in the parts of the terminal leg-receiving slots formed in the opposed walls of the electrical conductor-receiving slots defined by said electrical conductor guide portions; and the bifurcated outer ends of the legs of said electrical terminals are recessed with respect to outer ends of said electrical conductor guide portions.

* * * * *